US010803816B2

(12) United States Patent
Shan

(10) Patent No.: US 10,803,816 B2
(45) Date of Patent: Oct. 13, 2020

(54) DISPLAY DRIVING METHOD, DEVICE AND APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 456 days.

(21) Appl. No.: 15/751,430

(22) PCT Filed: Dec. 8, 2017

(86) PCT No.: PCT/CN2017/115316

§ 371 (c)(1),
(2) Date: Feb. 8, 2018

(87) PCT Pub. No.: WO2019/071784

PCT Pub. Date: Apr. 18, 2019

(65) Prior Publication Data

US 2020/0226988 A1 Jul. 16, 2020

(30) Foreign Application Priority Data

Oct. 10, 2017 (CN) ..... 2017 1 0936344

(51) Int. Cl.
*G09G 3/36* (2006.01)

(52) U.S. Cl.
CPC ... *G09G 3/3607* (2013.01); *G09G 2320/0242* (2013.01)

(58) Field of Classification Search
CPC combination set(s) only.
See application file for complete search history.

(56) References Cited

U.S. PATENT DOCUMENTS

2010/0123401 A1 5/2010 Park et al.
2014/0152724 A1 6/2014 Park et al.
(Continued)

FOREIGN PATENT DOCUMENTS

CN 101345036 A 1/2009
CN 102103840 B 3/2013
(Continued)

OTHER PUBLICATIONS

Chinese Office Action dated Mar. 26, 2019.
International Search Report dated Jul. 11, 2018.

*Primary Examiner* — Robin J Mishler
(74) *Attorney, Agent, or Firm* — Platinum Intellectual Property LLP

(57) ABSTRACT

The present disclosure relates to a display driving method, device and apparatus, an original gray scale data group of the pixel units in the preset display area and of the content to be displayed is acquired; average gray scales of the hues in the preset display area are determined according to the original gray scale data group; original light source intensities of each of the hues in the preset display area and of the content to be displayed are acquired; the original gray scale data group is divided into a first gray scale data group and a second gray scale data group and the driving light source intensities of each of the hues in the preset display area are determined according to the original gray scale data group of the pixel units, the average gray scales of each of the hues and the original light source intensities; the gray scales of each of the hues of the first gray scale data group are the maximal gray scale in the original gray scale data group; the gray scales of each of the hues of the second gray scale data group are 0 or greater than the minimal gray scale of the original gray scale data group.

20 Claims, 4 Drawing Sheets

(56) References Cited

U.S. PATENT DOCUMENTS

| | | | | |
|---|---|---|---|---|
| 2016/0180792 | A1* | 6/2016 | Kim | G09G 3/3648<br>345/205 |
| 2017/0154587 | A1* | 6/2017 | Chen | G09G 3/3607 |
| 2018/0374436 | A1* | 12/2018 | Chen | G09G 3/3607 |

FOREIGN PATENT DOCUMENTS

| | | | |
|---|---|---|---|
| CN | 105095875 | A | 11/2015 |
| CN | 105096875 | A | 11/2015 |
| CN | 106873205 | A | 6/2017 |
| CN | 107657928 | A | 2/2018 |
| CN | 107808648 | A | 3/2018 |
| CN | 107945751 | A | 4/2018 |
| CN | 105513559 | B | 8/2018 |
| CN | 107808647 | B | 6/2019 |

* cited by examiner

DISPLAY DRIVING METHOD, DEVICE AND APPARATUS

RELATED APPLICATIONS

This application is a United States National Stage Application filed under 35 U.S.C 371 of PCT patent application Ser. No. PCT/CN2017/115316, filed 8 Dec. 2017, which claims Chinese Patent Application Serial No. CN 201710936344.7, filed 10 Oct. 2017, the disclosure of all of which are hereby incorporated by reference in their entirety.

FIELD OF THE INVENTION

The present disclosure relates to the technology field of display, and particularly relates to a display driving method, device and apparatus.

BACKGROUND OF THE INVENTION

With the continuous development of science and technology, liquid crystal television, liquid crystal displayer and various other liquid crystal display devices are increasingly popular and are commonly equipped for residences, shopping malls, office buildings and other places that require information displaying, so as to facilitate the production or life of people.

However, in the color cast change of the side view and front view of various representative color schemes of a prior liquid crystal displayer, the side view color cast of schemes of red, green and blue is more serious over other color schemes, also, due to the fast saturation and escalation of the view angle brightness proportion of gray scale LCD, the front view brightness and side view brightness difference is greater as the gray scale is lower.

SUMMARY OF THE INVENTION

Accordingly, it is necessary to provide a display driving method, device and apparatus that can address the problem of the side view color cast.

A display driving method includes:

acquiring an original gray scale data group of each of pixel units of a content to be displayed in a preset display area;

determining an average gray scale of each of hues in the preset display area according to the original gray scale data group;

acquiring an original light source intensity of each of the hues of the content to be displayed in the preset display area;

dividing the original gray scale data group into a first gray scale data group and a second gray scale data group according to the original gray scale data group of each of the pixel units, the average gray scales of each of the hues, and the original light source intensities, and determining the driving light source intensities of each of the hues in the preset display area; the gray scales of each of the hues of the first gray scale data group are the maximal gray scale in the original gray scale data group; and the gray scales of each of the hues of the second gray scale data group are 0 or greater than the minimal gray scale of the original gray scale data group.

A display driving method comprising:

dividing a display region of a display into at least two display areas, and regarding the display areas as a preset display area sequentially;

acquiring an original gray scale data group of pixel units of a content to be displayed in the preset display area;

determining an average gray scale of each of hues in the preset display area according to the original gray scale data group;

acquiring an original light source intensity of each of the hues of the content to be displayed in the preset display area;

dividing the original gray scale data group into a first gray scale data group and a second gray scale data group according to the original gray scale data group of the pixel units, the average gray scales of each of the hues, and the original light source intensities, and determining driving light source intensities of each of the hues in the preset display area;

acquiring an original display duration of the original gray scale data group; and displaying the first gray scale data group and the second gray scale data group continuously in the original display duration.

A display driving device includes:

an original gray scale acquiring module configured to acquire an original gray scale data group of each of pixel units of a content to be displayed in a preset display area;

an average gray scale determination module configured to determine average gray scales of each of hues in the preset display area according to the original gray scale data group;

an original light source acquiring module configured to acquire original light source intensities of each of the hues of the content to be displayed in the preset display area; and a gray scale group dividing module configure to divide the original gray scale data group into a first gray scale data group and a second gray scale data group according to the original gray scale data group of the pixel units, the average gray scales of each of the hues, and the original light source intensities; and determine the driving light source intensities of each of the hues in the preset display area; the gray scales of each of the hues of the first gray scale data group are the maximal gray scale in the original gray scale data group; and the gray scales of each of the hues of the second gray scale data group is 0 or greater than the minimal gray scale of the original gray scale data group.

A computer apparatus includes a memory, a processor and a computer program stored in the memory and executable on the processor, the processor executes the computer program to provide steps of the display driving method according to the foregoing methods.

According to the display driving method, device and apparatus, the original gray scale data group is divided into a first gray scale data group and a second gray scale data group, that is to say, original frame signals corresponding to the pixel units are regarded as a combination of a plurality of frames; further, a gray scale of each of the hues of the first gray scale data group is a maximal gray scale in the original gray scale data group; and a gray scale of each of the hues of the second gray scale data group is equal to 0 or greater than a minimum gray scale in the original gray scale data group. As such, in order to highlight the dominant color and ameliorate the color cast, the gray scale data of each of the hues in the original gray scale data group is displayed according to the data greater than the minimum gray scale and in the original gray scale data group, or simply not displayed; and neither of the two groups contains the data color of the minimum gray scale in the original gray scale data group, thereby reducing the brightness difference between the hue of the low gray scale of the side view angle and the hue of the overall pixel unit, such that the hue of the side view angle is presented close to the hue of the front view angle.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Figure 1:
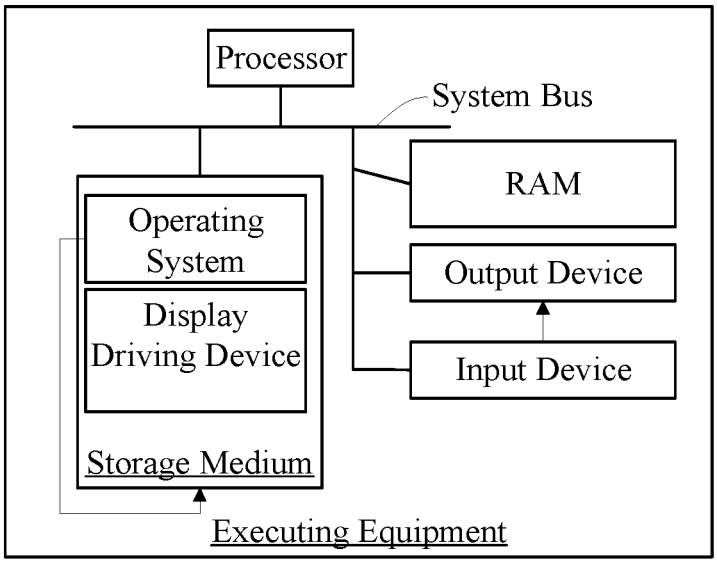
FIG. 1 is a block diagram of an executing device of a display driving method and apparatus according to an embodiment.

The present disclosure will be described in the following with reference to the accompanying drawings and the embodiments. Preferred embodiments are provided in the drawings. The various embodiments of the disclosure may, however, be embodied in many different forms and should not be construed as limited to the specific embodiments set forth hereinafter. Numerous specific details are described hereinafter in order to facilitate a thorough understanding of the present disclosure.

FIG. 1 is a block diagram of an executing device according to an embodiment. The executing device can be a terminal that implements the display driving method. The executing device includes a processor, a storage medium, a Random-Access Memory (RAM), an output device, and an input device connected through the system bus. An operating system and an computer application program of a display driving device are stored in the storage medium. When the computer application program of the display driving device is executed by the processor, a display driving method is implemented. The processor is configured to provide computation and control capability to support the operation of the executing device. The RAM provides an environment to the computer application program of the display driving device in the storage medium, the RAM has stored computer-readable instructions that, when executed by at least one processors, cause the at least one processor to perform a driving method for display. The output device of the executing apparatus can be a display screen, the display screen can be an displayer. The input device can be a touch layer covered on the display screen, a button, a trackball or a touch pad configured on the shell of an electronic device, or an external keyboard, touch pad or mouse and so on. A person skilled in the art should understand, FIG. 1 is exemplary to show the structure of the terminal in accordance with an embodiment of the present disclosure and does not limit the executing apparatus to this embodiment; in other embodiments, compared with the structure shown in FIG. 1, the particular terminal may include more or less components, be configured with other components not shown in FIG. 1, or have a different configuration.

Figure 2:
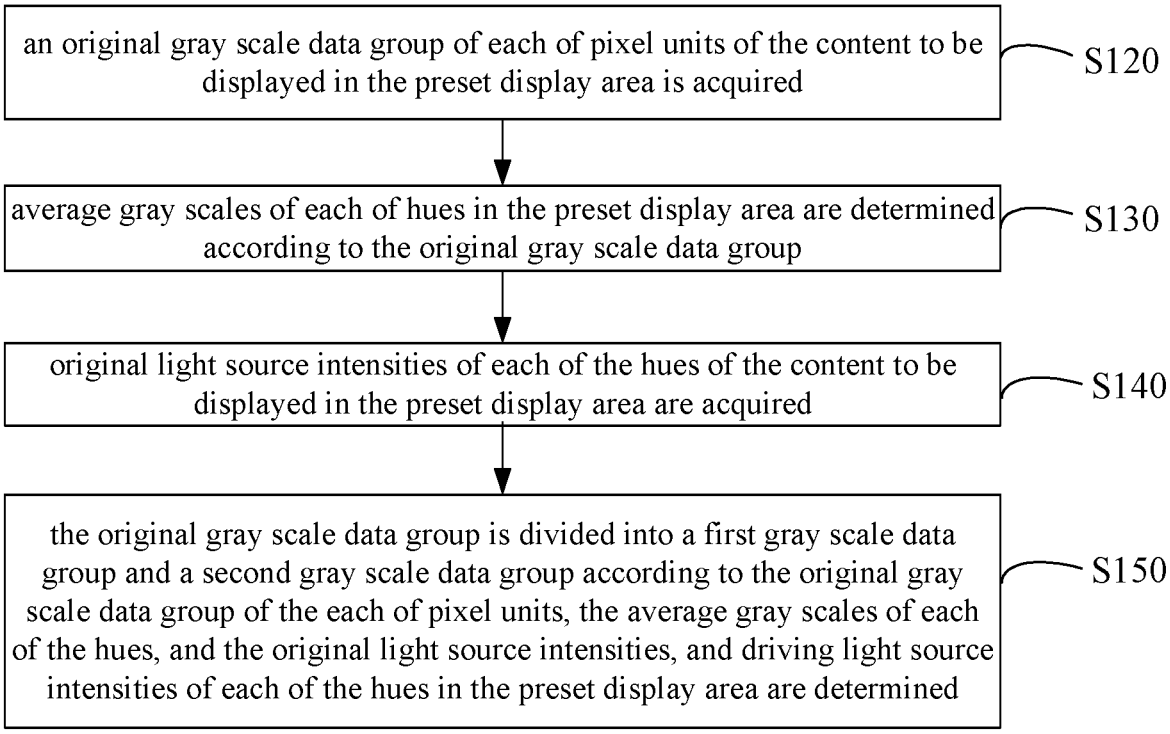
FIG. 2 is a flowchart of a display driving method according to an embodiment.

Referring to FIG. 2, a display driving method is provided, which includes:

In S120: an original gray scale data group of each of pixel units of the content to be displayed in the preset display area is acquired.

The displayer is composed with a plurality of RGB sub-pixel units, each group of RGB sub-pixels is called a pixel unit, each of which represents an image signal. The original gray scale data group of each of pixel units includes a gray scale of R, G, B three colors, for example, ($R_{n,m_i,j}$, $G_{n,m_i,j}$, $B_{n,m_i,j}$) can represent the original gray scale data group of the pixel unit at column i row j in the display area at column n row m. The display region of the displayer can be divided into a plurality of display areas, each of which includes at least two pixel units, the size of the display area is customizable, the displayer can be divided into N (columns)*M (rows) display sections composed by pixel units. Various display areas can serve as the preset display area according to a preset sequence, so as to implement the display driving method.

In S130: average gray scales of each of hues in the preset display area are determined according to the original gray scale data group.

average gray scales of the hues in the preset display area can be determined according to the original gray scale data group of the pixel units in the preset display area. By respectively summing up the hues of the original gray scale data group in each of the pixel units and then dividing by the number of pixel units in the preset display area, thereby the average gray scales of each of the hues in the preset display area are obtained, which is the average gray scale group in the preset display area. For example, ($Ave_R_{n,m}$, $Ave_G_{n,m}$, $Ave_B_{n,m}$) can be used to represent the average gray scale group of the display area at column n and row m.

In S140: original light source intensities of each of the hues of the content to be displayed in the preset display area are acquired.

By way of finding a data sheet, original light source strengths of various hues in a preset display area and of a content to be displayed are acquired, i.e., the original light source strength group in the preset display area and of the content to be displayed. It can be understood that the table can be pre-stored in the memory and be called when it is required; the table can also be obtained when it is required, and thereby obtaining the original light source intensity group of the content to be displayed in the preset display area. The original light source intensity group of the content to be displayed at column n and row m in the display area can be represented as ($A_{n\ m_R}$, $A_{n\ m_G}$, $A_{n\ m_B}$).

In S150: the original gray scale data group is divided into a first gray scale data group and a second gray scale data group according to the original gray scale data group of the each of pixel units, the average gray scales of each of the hues, and the original light source intensities, and driving light source intensities of each of the hues in the preset display area are determined. A gray scale of each of hues of the first gray scale data group is a maximal gray scale in the original gray scale data group and a gray scale of each of hues of the second gray scale data group is equal to 0 or greater than a minimum gray scale in the original gray scale data group.

The driving light source intensities of R, G, B of the two frames may be adjusted in the preset display area according to the average gray scales (such as $Ave_R_{n,m}$, $Ave_G_{n,m}$, $Ave_B_{n,m}$) of the hues of all the pixel units in the preset display area. $A_{n,m_R}$, $A_{n,m_G}$, $A_{n,m_B}$ of the original light source intensities of each of the hues of R, G, B are adjusted to $A'_{n,m_R}$, $A'_{n,m_G}$, $A'_{n,m_B}$ in the display area (n, m).

According to the display driving method, the original gray scale data group is divided into a first gray scale data group and a second gray scale data group, i.e., original frame signals corresponding to the pixel units are regarded as a combination of a plurality of frames; further, a gray scale of each of hues of the first gray scale data group is a maximal gray scale in the original gray scale data group; and a gray scale of each of hues of the second gray scale data group is equal to 0 or greater than a minimum gray scale in the original gray scale data group. As such, in order to highlight the dominant color and improve the color shift, the gray scale data of each of hues in the original gray scale data group is displayed according to the data greater than the minimum gray scale in the original gray scale data group, or simply not displayed; and both groups do not contain the data color of the minimum gray scale in the original gray scale data group, thereby reducing the brightness difference between the hue of the low gray scale of the side view angle and the hue of the overall pixel unit, such that the hue of the side view angle appears close to the presentation of the hue of the front view angle and achieve an image presentation with low color cast.

Figure 3:
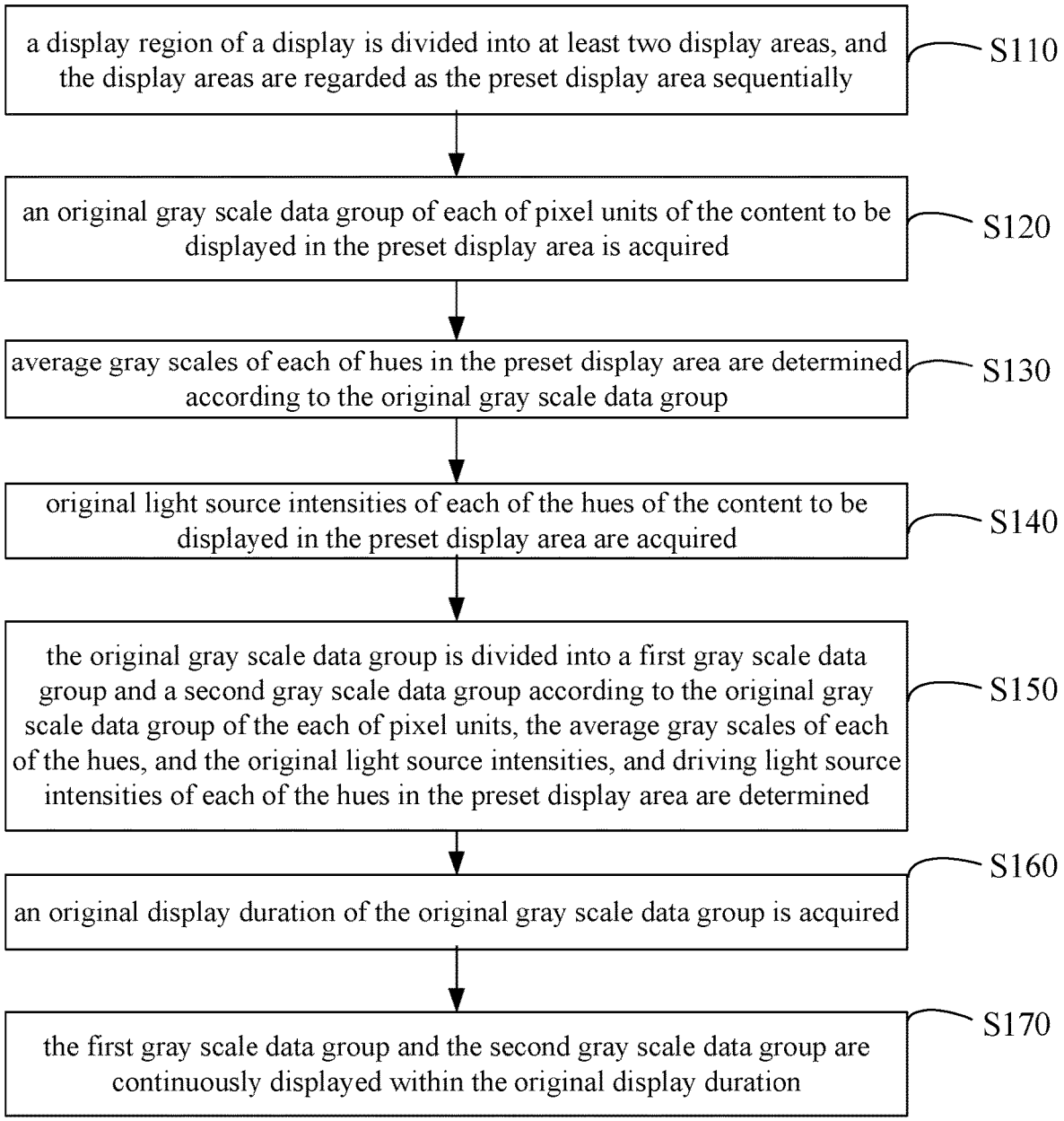
FIG. 3 is a flowchart of a display driving method according to another embodiment.

Referring to FIG. 3, in an embodiment, after a step of dividing the original gray scale data group into the first gray scale data group and the second gray scale data group, the method further includes:

In S160: an original display duration of the original gray scale data group is acquired.

In S170: the first gray scale data group and the second gray scale data group are continuously displayed within the original display duration.

In the present embodiment, the gray scale data group of the original frame corresponding to the first pixel unit is divided into a first gray scale data group and a second gray scale data group of two frames (a first frame and a second picture frame) corresponding to the pixel unit. The combination of the two frames is time-sequentially presented, i.e., the first gray scale data group and the second gray scale data group are displayed sequentially. The original display duration is divided into two time periods, among which the first gray scale data group is displayed in one time period, the second gray scale data group is displayed in another time period. Preferably, to ensure the display performance, the two time periods are of a same length, i.e., they are both a half of the original display duration.

Figure 4:
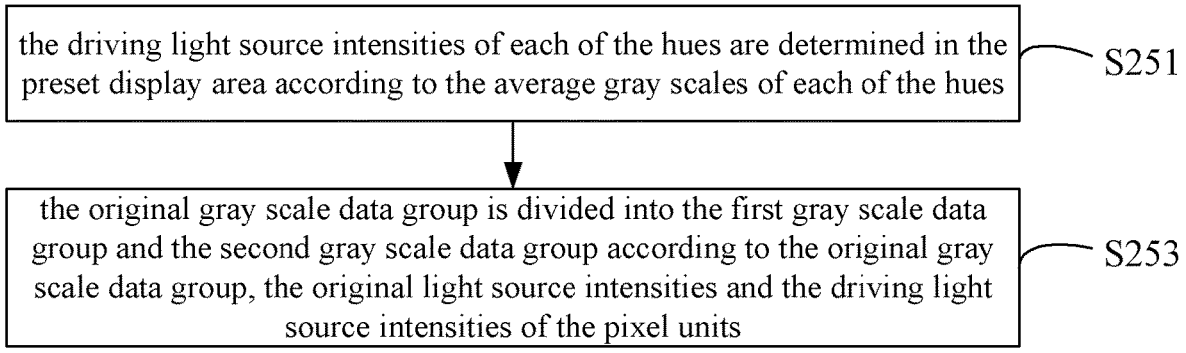
FIG. 4 is a specific flowchart of a display driving method of FIG. 2 or FIG. 3.

Referring to FIG. 4, the step of dividing the original gray scale data group into the first gray scale data group and the second gray scale data group, according to the original gray scale data group of the pixel unit, the average gray scales of each of the hues, and the original light source intensities; and determining the driving light source intensities of each of the hues in the preset display area includes:

In S251: the driving light source intensities of each of the hues are determined in the preset display area according to the average gray scales of each of the hues.

It may be determined according to the average gray scales in the preset display area that the maximal gray scale in the average gray scales belongs to the maximal average gray scale sub-pixel dominated by which hue of R, G and B; and it is determined that the maximal gray scale of most pixel units is the hue of one sub-pixel of R, G and B in the preset display area. As such, the driving light source intensities of each of the hues can be further determined in the preset display area according to the hue corresponding to the maximal gray scale in the average gray scales of each of the hues in the preset display area.

Assuming that the average gray scales of each of the hues of all the pixel units in the display area (n, m) are $Ave_R_{n,m}=A$, $Ave_G_{n,m}=B$, $Ave_B_{n,m}=C$, where A>B>C, so that the display area is a combination of red hues. The average gray scales Ave_Rn, m, $Ave_G_{n,m}$, $Ave_B_{n,m}$ of each of the hues of R, G, B are divided into two frame gray scale combinations respectively: R1G1B1 combination 1 (the first gray scale data group) and R2G2B2 combination 2 (the second gray scale data group). Where the gray scale of each of the hues in the R1G1B1 combination 1 is the maximal gray scale in the average gray scales, i.e. A; that is, R1=A, G1=A, and B1=A. The gray scale of each of hues in the R2G2B2 combination 2 is: the hue R2 corresponding to the maximal average gray scale A is equal to 0, and the gray scales of the two hues G2 and B2 is the second maximal average gray scale, i.e. B, that is, R2=0, G2=B, B2=B.

The driving light source intensities $A'_{n,m_R}$, $A'_{n,m_G}$, $A'_{n,m_B}$ of respective hues of R, G and B are calculated according to the gray scales of respective hues of the first gray scale data group and the second gray scale data group, such that the overall brightness of R, G and B signals is maintained the same as that of the original frame. The driving light source intensities $A'_{n,m_R}$, $A'_{n,m_G}$, $A'_{n,m_B}$ of respective hues of R, G and B are calculated as follows:

$$A'_{n,m_R}=2*TR(A)*A_{n,m_R}/(TR(A)+0)=2*A_{n,m_R};$$

$$A'_{n,m_G}=2*TG(B)*A_{n,m_G}/(TG(A)+TG(B));$$

$$A'_{n,m_B}=2*TB(C)*A_{n,m_B}/(TB(A)+TB(B)).$$

It should be noted that the brightness ratios corresponding to the average gray scales of respective hues of R, G and B may be obtained in the preset display area by table look-up: TR(A), TG(B) and TB(C) respectively. The brightness ratios corresponding to respective hues of the first gray scale data group can be obtained by table look-up: TR(A), TG(A) and TB(A) respectively. The brightness ratios corresponding to respective hues of the second gray scale data group can be obtained by table look-up: TR(0)=0, TG(B) and TB(B) respectively. The brightness ratio is the brightness ratio value of the gray scale of the corresponding hue with respect to the full gray scale. It can be understood that these data tables can be pre-stored in the memory, and the corresponding brightness ratios can be directly obtained when needed. The data tables can also be obtained when needed, so as to obtain the brightness ratios.

In S253: the original gray scale data group is divided into the first gray scale data group and the second gray scale data group according to the original gray scale data group, the original light source intensities and the driving light source intensities of the pixel units.

According to the maximal gray scale of each of the hues in the original gray scale data group of each of pixel units, the first gray scale data group of the first frame corresponding to the pixel unit can be determined. Further in combination with the first gray scale data group, the original light source intensities and the driving light source intensities, a group of brightness ratios of the gray scale of the second frame corresponding to the pixel unit after division with respect to the full gray scale can be determined according to law of brightness conservation. The group of brightness ratios includes the brightness ratio of each of the hues; it can be understood that the brightness ratio is the brightness ratio value of the gray scale of the corresponding hue in relation to the full gray scale. After the two groups of brightness ratios are determined, the gray scale of each of the hues in the first gray scale data group and the second gray scale data group may be determined by table look-up. It should be noted that the frame corresponding to the pixel unit includes the original frame corresponding to the pixel unit before decomposition, and the first frame and the second frame corresponding to the pixel unit after the decomposition.

Further, a step of decomposing the original gray scale data group into the first gray scale data group and the second gray scale data group according to the original gray scale data group of the pixel units, the original light source intensities and the driving light source intensities includes:

(a). a maximal gray scale of each of the hues of the pixel unit is regarded as the gray scale of each of the hues of the first gray scale data group.

(b). a brightness ratio of the gray scale of each of the hues of the first gray scale data group in relation to a full gray scale is determined according to the gray scale of each of the hues of the first gray scale data group.

(c). a brightness ratio of the gray scale of each of the hues of the second gray scale data group in relation to the full gray scale is determined according to the brightness ratio of the gray scale of each of the hues of the first gray scale data group in relation to the full gray scale, the original light source intensity and the driving light source intensity.

In a first example:

The average gray scales of each of the hues of all the pixel units in the display area are $Ave_R_{n,m}=A$, $Ave_G_{n,m}=B$, $Ave_B_{n,m}=C$, where A>B>C, so that the display area is a combination of red hues. The original gray scale data group of most pixel units in the preset display area is represented as ($R_{n,m_i,j}=A1$, $G_{n,m_i,j}=B1$, $B_{n,m_i,j}=C1$), and most pixel units meet the combination of red hues of A1>B1>C1. In this case, the maximal gray scale in the original gray scale data group of the pixel unit $R_{i,j}$, $G_{i,j}$, $B_{i,j}$ is A1. The pixel unit is divided from 1 frame (the original frame) into a combination of 2 frames (a first frame and a second frame). After division, the gray scales of respective hues of $R_{i,j}$, $G_{i,j}$, and $B_{i,j}$ corresponds to the first gray scale data group ($R1_{i,j}$, $G1_{i,j}$, $B1_{i,j}$) and the second gray scale data group ($R2_{i,j}$, $G2_{i,j}$, $B2_{i,j}$) respectively. Where, the gray scale of each of the hues of the first gray scale data group is the maximal gray scale in the original gray scale data group, i.e. A1, that is, $R1_{i,j}=A1$, $G1_{i,j}=A1$, $B1_{i,j}=A1$. The brightness ratios of the gray scales of respective hue of the first gray scale data group with respect to the full gray scale may be determined by a look-up table: TR(A1), TG(A1) and TB(A1) respectively. In combination with the original light source intensities $A_{n,m_R}$, $A_{n,m_G}$, $A_{n,m_B}$ and the driving light source intensities $A'_{n,m_R}$, $A'_{n,m_G}$, $A'_{n,m_B}$ of each of the hues of R, G and B in the preset display area, the brightness ratios $TR(R2_{i,j})$, $TG(G2_{i,j})$, $TB(B2_{i,j})$ of the gray scales of respective hues of the second gray scale data group with respect to the full gray scale can be determined according to the law of brightness conservation, so that the gray scale of each of the hues can be further determined by a look-up table according to the brightness ratio. In one specific example, the calculation formula of the brightness ratios $TR(R2_{i,j})$, $TR(G2_{i,j})$ and $TB(B2_{i,j})$ of the gray scales of respective hues of the second gray scale data group with respect to the full gray scale is as follows:

$$TR(R2_{i,j})=(2*A_{n,m_R}*TR(A1)-A'_{n,m_R}*TR(A1))/A'_{n,m_R}=0;$$

$$TG(G2_{i,j})=(2*A_{n,m_G}*TG(B1)-A'_{n,m_G}*TG(A1)))/A'_{n,m_G}=((TG(A)+TG(B))/TG(B))*TG(B1)-TG(A1);$$

$$TB(B2_{i,j})=(2*A_{n,m_B}*TB(C1)-A'_{n,m_B}*TB(A1))/A'_{n,m_B}=((TB(A)+TB(B))/TB(C))*TB(C1)-TB(A1).$$

In a second example:

The average gray scales of each of the hues of all the pixel units in the display area are $Ave_R_{n,m}=A$, $Ave_G_{n,m}=B$, $Ave_B_{n,m}=C$, where A>B>C, so that the display area is a combination of red hues. If the original gray scale data group of other pixel units is present in the preset display area as ($R'_{i,j}=A2$, $G'_{i,j}=B2$, $B'_{i,j}=C2$), the pixel unit is a combination of green hues of B2>C2>A2, which is different from the size order of the average gray scales of the preset display area. The gray scales of each of the hues of the pixel unit $R'_{i,j}$, $G'_{i,j}$, $B'_{i,j}$ is divided from 1 frame (an original frame) into a combination of two frames (a first frame and a second frame) corresponding to the first gray scale data group ($R'1_{i,j}$, $G'1_{i,j}$, $B'1_{i,j}$) and the second gray scale data group ($R'2_{i,j}$, $G'2_{i,j}$, $B'2_{i,j}$) respectively. Where, the gray scale of each of the hues of the first gray scale data group is the maximal gray scale in the original gray scale data group, i.e. B2, that is, $R'1_{i,j}=B2$, $G'1_{i,j}=B2$, $B'1_{i,j}=B2$. The brightness ratios of the gray scales of respective hue of the first gray scale data group with respect to the full gray scale may be determined by a look-up table: TR(B2), TG(B2) and TB(B2) respectively. In combination with the original light source intensities $A_{n,m_R}$, $A_{n,m_G}$, $A_{n,m_B}$ and the driving light source intensities $A'_{n,m_R}$, $A'_{n,m_G}$, $A'_{n,m_B}$ of each of hues of R, G and B in the preset display area, the brightness ratios $TR(R'2_{i,j})$, $TG(G'2_{i,j})$, $TB(B'2_{i,j})$ of the gray scales of respective hues of the second gray scale data group with respect to the full gray scale can be determined according to law of brightness conservation, so that the gray scale of each of the hues can be further determined by a look-up table according to the brightness ratio. In one specific example, the calculation formula of the brightness ratios $TR(R'2_{i,j})$, $TR(G'2_{i,j})$ and $TB(B'2_{i,j})$ of the gray scales of respective hues of the second gray scale data group with respect to the full gray scale is as follows:

$$TR(R'2_{i,j})=(2*A_{n,m_R}*TR(A2)-A'_{n,m_R}*(TR(B2)))/A'_{n,m_R}=TR(A2)-TR(B2), \text{ if } TR(R'2_{i,j})>Y, TR(R'2_{i,j})=Y, \text{ if } TR(R'2_{i,j})<0, TR(R'2_{i,j})=0;$$

$$TG(G'2_{i,j})=(2*A_{n,m_G}*TG(B2)-A'_{n,m_G}*(TG(B2)))/A'_{n,m_G}=((TG(A)+TG(B))/TG(B))*TG(B2)-TG(B2), \text{ if } TG(G'2_{i,j})>Y, TG(G'2_{i,j})=Y, \text{ if } TG(G'2_{i,j})<0, TG(G'2_{i,j})=0;$$

$$TB(B'2_{i,j})=(2*A_{n,m_B}*TB(C2)-A'_{n,m_B}*(TB(C2)))/A'_{n,m_B}=((TB(A)+TB(B))/TB(C))*TB(C2)-TB(B2), \text{ if } TB(B'2_{i,j})>Y, TB(B'2_{i,j})=Y, \text{ if } TB(B'2_{i,j})<0, TB(B'2_{i,j})=0.$$

It should be noted that since the size order of the original gray scale data group of the pixel unit is different from that of the average gray scales of the preset display area, the brightness ratios of the gray scales of respective hues of the second gray scale data group ($R'2_{i,j}$, $G'2_{i,j}$, $B'2_{i,j}$) corresponding to the pixel unit with respect to the full gray scale may be determined by the above formula, and then the brightness ratio may be lower than 0 or greater than a preset maximal value. Therefore, it should be required to determine values of the calculated brightness ratios $TR(R'2_{i,j})$, $TG(G'2_{i,j})$ and $TB(B'2_{i,j})$ of the gray scales of respective hues of the second gray scale data group with respect to the full gray scale. If the value is less than 0, the brightness ratio is set up to be 0; and if the value is greater than the preset maximal value Y, the brightness ratio is set as the preset maximal value Y.

In an embodiment, the step of determining the driving light source intensities of each of the hues in the preset display area includes: upon determining that the second gray scale data group is displayed, the driving light source intensity of each of the hues corresponding to the maximal gray scale in the average gray scales of the preset display area is set up as 0.

As the maximal gray scale of the average gray scales is regarded as the average gray scale of a kind of hue in the preset display area, the hues corresponding to the maximal gray scales of most pixel units in the preset display area are consistent to the hues corresponding to such maximal gray scales. And the maximal gray scale is regarded as the gray scales of the hues of the first gray scale data group, therefore upon determining that the second gray scale data group is displayed, the driving light source intensity of each of the hues corresponding to the maximal gray scale in the average gray scales of the preset display area is set up to be 0, such that the overall display is not serious affected, and an energy saving and emission reducing effect can be achieved in the meanwhile.

Such as in the foregoing first kind of embodiment, the size order of the gray scales of most pixel units in the preset display area is consistent with the size order of the average gray scales of $Ave_R_{n,m}=A$, $Ave_G_{n,m}=B$, $Ave_B_{n,m}=C$, where A>B>C. After the original gray scale data group is divided, the driving light source intensity $A'_{n,m_R}$ of the red hue of the first gray scale data group is twice the original brightness intensity of the foregoing red hue, i.e., $A'_{n,m_R}=2*A_{n,m_R}$, the driving light source intensity $A'_{n,m_R}$ of the red hue of the second gray scale data group can be set up as 0 signal. Such as in the foregoing second kind of embodiment, the size order of the gray scales of other pixel units in the preset display area is different from the size order of the average gray scales of $Ave_R_{n,m}=A$, $Ave_G_{n,m}=B$, $Ave_B_{n,m}=C$, where A>B>C. The brightness ratios of each of the hues of the second gray scale data group calculated based on the original light source intensities and the driving light source intensities are $TR(R'2_{i,j})=(2*A_{n,m_R}*TR(A2)-A'_{n,m_R}*TR(B2))/A'_{n,m_R}=TR(A2)-TR(B2)$, it can be determined that $TR(A2)-TR(B2)<0$, then the gray scale R'2i,j of the red hue of the second gray scale data group can be set up to be 0, setting up the matching driving light source intensity $A'_{n,m_R}$ of the foregoing second gray scale data group to be 0 does not affect the overall result, therefore upon determining that the second gray scale data group is displayed, the driving light source intensity of the red hue in the preset display area is set up to be 0, i.e., the backlight source R LED light source can be turned off, so as to save energy. It can be understood that in other embodiments, the hue corresponding to the maximal gray scale in the average gray scales can be green or blue, and is not limited to the red in the foregoing embodiment.

In order to reduce the affect by the inaccurate signal and over the display, in an embodiment, the step where the driving light source intensities of each of the hues in the preset display area are determined includes (1) and (2).

(1) acquiring, in the average gray scales and in the second gray scale data group in the preset display area, a first quantity that the gray scale of the hues corresponding to the maximal gray scale is 0, and a second quantity that the gray scale of the hues corresponding to the second maximal gray scale is 0.

(2) when the first quantity satisfies a first preset condition and the second quantity satisfies a second preset condition, the driving light source intensities of each of the hues in the preset display area is determined.

When the brightness ratio of the hue corresponding to the maximal gray scale in the average gray scale and in the second gray scale data group in the preset display area is greater than a first preset value, the gray scale of the hues corresponding to the maximal gray scale in the average gray scale and among the second gray scale data group in the preset display area is 0.

When the brightness ratio of the hue corresponding to the second maximal gray scale in the average gray scale and in the second gray scale data group in the preset display area is greater than a second preset value, the gray scale of the hues corresponding to the second maximal gray scale in the average gray scale and among the second gray scale data group in the preset display area is 0.

The first quantity includes: a maximal in-array quantity and/or a maximal total quantity. The maximal in-array quantity is the pixel unit quantity that the gray scale of the hues corresponding to the maximal gray scale in the average gray scale and among the second gray scale data group in the preset matrix in the preset display area is 0. The maximal total quantity is the pixel unit quantity that the gray scale of the hues corresponding to the maximal gray scale in the average gray scale and among the second gray scale data group in the preset display area is 0. The preset matrix is a matrix block composed by k*k consecutive pixel units. Where the k is less than the row numbers and column numbers of the preset display area.

The second quantity includes: a second maximal in-array quantity and/or a second maximal quantity. The maximal in-array quantity is the pixel unit quantity that the gray scale of the hues corresponding to the second maximal gray scale in the average gray scale and among the second gray scale data group in the preset matrix in the preset display area is 0. The second maximal total quantity is the pixel unit quantity that the gray scale of the hues corresponding to the second maximal gray scale in the average gray scale and among the second gray scale data group in the preset display area is 0.

The first preset condition includes: the ratio of the maximal in-array quantity to the pixel unit quantity in the preset matrix is no greater than a first preset ratio; and/or the ratio of the maximal total quantity to the pixel unit quantity in the preset display area is greater than a second preset ratio.

The second preset condition includes: the ratio of the second maximal in-array quantity to the pixel unit quantity in the preset matrix is no greater than a third preset ratio; and/or the ratio of the second maximal total quantity to the pixel unit quantity in the preset display area is no greater than a forth preset ratio.

In a specific embodiment, assume the average gray scales of the pixel units in the preset display area (n, m) are $Ave_R_{n,m}=A$, $Ave_G_{n,m}=B$, $Ave_B_{n,m}=C$, where A>B>C, when the ratio of the maximal in-array quantity of the brightness ratio $TR(R'2_{n,m_i,j})$ of the red hue corresponding to the maximal gray scale $Ave_R_{n,m}$ in the average gray scales among the second gray scale data group in the preset display area and satisfying $TR(R'_{2_n,m_i,j})\leq CTH1$ (CTH1 is a first preset value, which is a customized value less than 0) in consecutive pixel units of the preset matrix k*k to the quantity of the k*k consecutive pixel units is greater than a first preset ratio X1, then the original gray scale data group dividing function of the preset display area is not enabled. Alternatively, when the ratio of the pixel unit quantity (i.e., the maximal total quantity) of the brightness ratio $TR(R'2_{n,m_i,j})$ of the red hue corresponding to the maximal gray scale $Ave_R_{n,m}$ in the average gray scales among the second gray scale data group in the preset display area and satisfying $TR(R'2_{_n,m_i,j})\leq CTH2$ (CTH2 is a first preset value, which is a customized value less than 0) to the quantity of the pixel units in the preset display area is greater than a second preset ratio Y1, then the original gray scale data group dividing function of the preset display area is also not enabled.

When the ratio of the second maximal in-array quantity of the brightness ratio $TG(G'2_{n,m_i,j})$ of the green hue corresponding to the second maximal gray scale $Ave_G_{n,m}$ in the average gray scales among the second gray scale data group in the preset display area and satisfying $TG(R'2_{n,m_i,j})\leq CTH3$ (CTH3 is a second preset value, which is a customized value less than 0) in consecutive pixel units of the preset matrix k*k to the quantity of the k*k consecutive pixel units is greater than a third preset ratio X2 then the original gray scale data group dividing function of the preset display area is not enabled. Alternatively, when the ratio of the pixel unit quantity (i.e., the second maximal total quantity) of the brightness ratio $TG(G'2_{n,m_i,j})$ of the green hue corresponding to the second maximal gray scale $Ave_G_{n,m}$ in the average gray scales among the second gray scale data group in the preset display area and satisfying $TG(G'2_{_n,m_i,j})\leq CTH4$ (CTH4 is a second preset value, which is a customized value less than 0) to the quantity of the pixel units in the preset display area is greater than a forth preset ratio Y2, then the original gray scale data group dividing function of the preset display area is also not enabled.

Referring to FIG. 3, in an embodiment, prior to the step of acquiring the original gray scale data group of each of pixel units of the content to be displayed in a preset display area, the method further includes:

S110: a display region of a display is divided into at least two display areas, and the display areas are regarded as the preset display area sequentially.

Each of the display areas can serve as the preset display area according to a preset sequence, so as to implement the display driving. The preset sequence can be a sequence where a row sorting is first performed prior to a column sorting, or a sequence where a column sorting is performed prior to a row sorting. As such, the display driving is performed to various display areas of the entire displayer, thereby implementing the display driving for the entire displayer.

In an embodiment, the step of dividing the original gray scale data group into the first gray scale data group and the second gray scale data group, according to the original gray scale data group of the each of pixel units, the average gray scales of each of the hues, and the original light source intensities, and determining the driving light source intensities of each of the hues in the preset display area includes: if the gray scales of respective hues in the preset display area are the same original gray scale data group, the average gray scales of respective hues are the gray scales of respective hues of the original gray scale data group. In this case, the original gray scale data group is divided into the first gray scale data group and the second gray scale data group, where the gray scale of each of hues of the first gray scale data group is the maximal gray scale in the original gray scale data group, and the gray scale of each of hues of the second gray scale data group is 0 or the second maximal gray scale in the original gray scale data group; the driving light source intensities of each of the hues in the preset display area is determined according to the original light source intensities, the first gray scale data group and the second gray scale data group.

As an specific example, when all the gray scales of each of the hues in the preset display area are red hue combinations that R=100, G=80, B=40, the original gray scale data group of the original frame corresponding to the pixel unit is divided into the first gray scale data group (R1, G1, B1) and the second gray scale data group (R2, G2, B2) of the two frames corresponding to the pixel unit. Where the gray scales of each of the hues in the first gray scale data group are the maximal gray scale in the original gray scale data group, i.e., 100, which is R1=100, G1=100, B1=100. The gray scales of each of the hues in the second gray scale data group are the gray scales of each of the hues that are 0, or the second maximal gray scales in the original gray scale data group, particularly, R2=0, G2=80, B2=80. The original gray scale data group is divided into two gray scale data groups, the two gray scale data groups are time-sequentially presented. That is, the original display duration of the original frame is required to be equally divided into three time periods, where one time period presents the first gray scale data group and another time period presents the second gray scale data group.

Assuming the brightness ratios of the front view of the original gray scale data group ($R_{i,j}$=100, $G_{i,j}$=80, $B_{i,j}$=40) of a pixel unit to a full gray scale 255 are SR %, LG %, MB %, correspondingly, the side view brightness ratios are SR' %, LG' %, MB' %, where SR>LG>MB and SR'>LG'>MB'.

Since the front view and side view brightness ratio difference is greater as the gray scale signal is lower, it can be understood that SR/MB>SR'/MB' and LG/MB>LG'/MB', the color is mixed such that the brightness ratio of the primary brightness signal SR at the front view is greater than that of MB in terms of difference, still, in the case of side view, the brightness ratio of the primary brightness signal SR' is less than that of MB' in terms of difference, the color brightness is reduced as the dominant hue color of the front view is affected. In view of the optical-electrical characteristics of prior VA displays, the brightness variation corresponding to a standard signal is a relation conforming to an exponent 2.2. For example, Y=(X/255)2.2, Y is a normalization brightness, X is a gray scale (a preferred gray scale is a 8 bit signal between 0 and 255), by way of looking up a table or that the brightness variation corresponding to the above signal is a relation conforming to the exponent 2.2, it can be determined that SR %=13.3%, LG %=7.4%, MB=1.7%, SR' %=39%, LG' %=34.7%, MB'=23.1%.

As all the gray scales of the first gray scale data group are 100, by way of table look-up, it can be determined that the front view brightness ratios of each of the hues of the first picture frame are respectively: 13.3%, 12.1%, 12.1%, and the side view brightness ratios are respectively: 39%, 41%, 49%. As to the second gray scale data group ($R2_{i,j}$=0, $G2_{i,j}$=80, $B2_{i,j}$=80), by way of table look-up, it can be determined that the front view brightness ratios of each of the hues of the second frame are respectively: 0%, 7.4%, 7.4%, and the side view brightness ratios are respectively: 0%, 34.7%, 42.1%.

Since the original one frame is changed, time-sequentially, from one frame to two frames, the frame frequency of the displayer shall be increased by one time, and the displaying duration for each of the frame is ½ of the original display duration. Assuming the original display duration of the original frame signal is T, then it is divided and is a sum of the durations of two frames time-sequentially, as each of the frame durations after division is ½ of the original frame signal, the driving light source intensities of the time-sequentially divided two frames must therefore be cooperatively increased by one time, i.e., the driving light source intensities of each of the hues of R, G, B must be increased to be twice as much the original light source intensity, such that the overall brightness is maintained to be the same as the original frame signal. For hue R, the original light source intensity is A_R, the driving light source intensity should be increased to be twice the original light source intensity, i.e., the backlight brightness must be A'_R=2*A_R, further, as for the brightness ratio of hue G and hue B, TG(G1)+TG(G2)=TG(100)+TG(80)=13.3%+7.4%=20.7% is greater than the hue original brightness ratio TG(80)=7.4%, and TB(B1)+TB(B2)=TB(100)+TB(80)=12.1%+7.4%=19.5% is greater than the original brightness ratio TB(40)=1.7% of hue B. As such, the brightness conservation of the front view of hues G, B can only be maintained with assistance by adjusting the driving light source intensities of hues G, B, therefore, A'_G=2*A_G*TG(80)/(TG(100)+TG(80))=0.715*A_G, likewise, A'_B=2*A_B*TB(40)/(TB(100)+TB(80))=0.174*A_B.

As the comprehensive brightness ratios of the combination of the side view frame 1 and frame 2 at each of the hues $R_{i,j}$, $G_{i,j}$, $B_{i,j}$ are respectively (39%+0%)*2=78%, (41%+34.7%)*0.715=54.1%, (49%+42.1%)*0.174=15.9%; while brightness ratios of each of the hues $R_{i,j}$, $G_{i,j}$, $B_{i,j}$ of the side view of the original frame are respectively 39%, 34.7%, 23.1%, accordingly, brightness ratio of the dominant hue R in relation to hue B is increased from 39%/23.1%=1.696 of the original picture frame to 78%/15.9%=4.9 of the combined picture frame, likewise, the value of the brightness ratio of the dominant hue R to hue G is increased from 39%/34.7%=1.127 of the original picture frame to 78%/54.1%=1.44 of the combined picture frame, such combined frames lowered the equivalent brightness in large viewing angle of low gray scale of the original frame, such that the dominant hue is remarkably escalated in relation to other hues, such that the side view is relatively close to the presentation of the dominant hue of the front view. It should be noted that, the dominant hue is the hue corresponding to the maximal gray scale in the original gray scale data group corresponding to the pixel unit.

Figure 5:
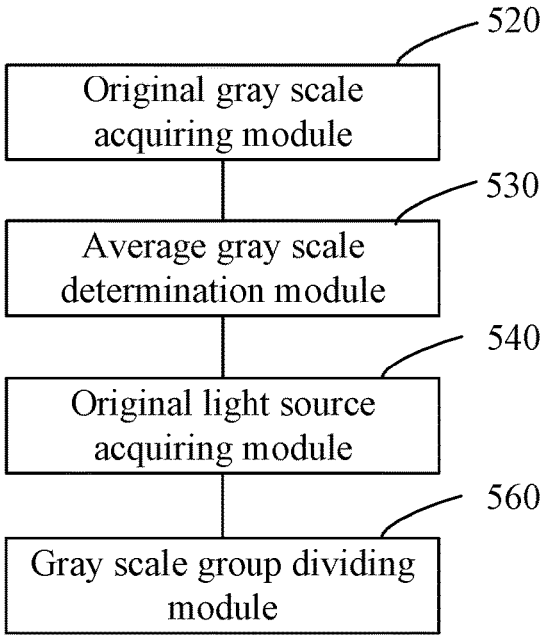
FIG. 5 is a block diagram of a display driving device according to an embodiment.

Referring to FIG. 5, a display driving device corresponding to foregoing method is also provided herein, which includes:

An original gray scale acquiring module 520 configured to acquire an original gray scale data group of each of the pixel units of the content to be displayed in the preset display area;

An average gray scale determination module 530 configured to determine average gray scales in the preset display area according to the original gray scale data group;

An original light source acquiring module 540 configured to acquire original light source intensities of each of the hues of a content to be displayed in a preset display area;

A gray scale group dividing module 560 configure to, according to the original gray scale data group of the pixel units, the average gray scales of each of the hues, the original light source intensities, divide the original gray scale data group into a first gray scale data group and a second gray scale data group, and the driving light source intensities of each of the hues in the preset display area are determined; the gray scales of each of the hues of the first gray scale data group are the maximal gray scale in the original gray scale data group; the gray scales of each of the hues of the second gray scale data group is 0 or greater than the minimal gray scale of the original gray scale data group.

According to the display driving device, the original gray scale data group is divided into a first gray scale data group and a second gray scale data group, i.e., original frame signals corresponding to the pixel units are regarded as a combination of a plurality of frames; further, a gray scale of each of hues of the first gray scale data group is a maximal gray scale in the original gray scale data group; and a gray scale of each of hues of the second gray scale data group is equal to 0 or greater than a minimum gray scale in the original gray scale data group. As such, in order to highlight the dominant color and improve the color shift, the gray scale data of each of hues in the original gray scale data group is displayed according to the data greater than the minimum gray scale in the original gray scale data group, or simply not displayed; and both groups do not contain the data color of the minimum gray scale in the original gray scale data group, thereby reducing the brightness difference between the hue of the low gray scale of the side view angle and the hue of the overall pixel unit, such that the hue of the side view angle appears close to the presentation of the hue of the front view angle and achieve an image presentation with low color cast.

In an embodiment, the gray scale dividing module is further configured to acquire, in the average gray scales and in the second gray scale data group in the preset display area, a first quantity that the gray scale of the hues corresponding to the maximal gray scale is 0, and a second quantity that the gray scale of the hues corresponding to the second maximal gray scale is 0; and when the first quantity satisfies a first preset condition and the second quantity satisfies a second preset condition, the driving light source intensities of each of the hues in the preset display area are determined.

Figure 6:
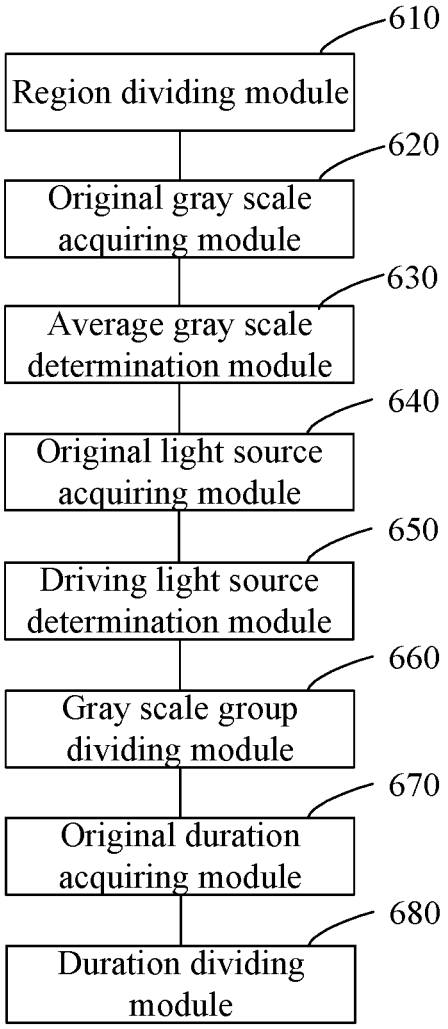
FIG. 6 is a block diagram of a display driving device according to another embodiment.

Referring to FIG. 6, in an embodiment, the apparatus further includes:

An original duration acquiring module 670 configured to acquire an original display duration of the original gray scale data group;

A duration dividing module 680 configured to continuously display the first gray scale data group and the second gray scale data group within the original display duration.

Continue the reference to FIG. 6, in an embodiment, the apparatus further includes a driving light source determination module 650;

The driving light source determination module 650 is configured to determine the driving light source intensities of each of the hues in the preset display area according to the average gray scales of each of the hues.

The gray scale group division module 660 is configured to divide the original gray scale data group into a first gray scale data group and a second gray scale data group according to the original gray scale data, the original light source intensities and the driving light source intensities of each of the pixel units.

Figure 7:
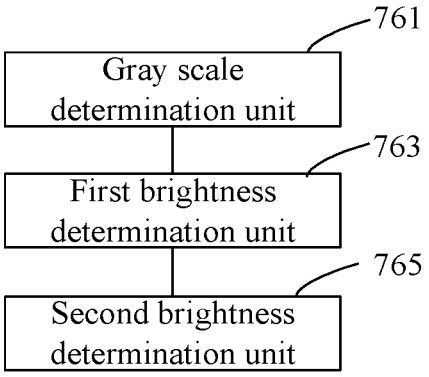
FIG. 7 is a block diagram of a module of a display driving device in FIG. 5 or FIG. 6.

Referring to FIG. 7, in an embodiment, the gray scale group dividing module includes:

A gray scale determination unit 761 configured to regarding the maximal gray scales of each of the hues of the pixel unit as the gray scales of each of the hues in the first gray scale data group;

A first brightness determination unit 763 configured to determine the brightness ratios of the gray scales of each of the hues in the first gray scale data group with respect to the full gray scale according to the gray scales of each of the hues of the first gray scale data group;

A second brightness determination unit 765 configured to determine the brightness ratios of the gray scales of each of the hues in the second gray scale data group with respect to the full gray scale according to the brightness ratios of the gray scales of each of the hues in the first gray scale data group with respect to the full gray scale, original light source intensities and the driving light source intensities.

Continue the reference to FIG. 6, in an embodiment, the apparatus further includes:

A region dividing module 610 configured to divide the display region of the displayer into at least two display areas and sequentially regard the display areas as the preset display area.

A computer apparatus corresponding to the foregoing method is also provided.

A computer apparatus includes a memory, a processor and a computer program stored in the memory and executable on the processor, the processor executes the computer program to provide steps of the foregoing display driving method.

As the foregoing display driving device and display driving method are corresponding to each other, with respect to the specific technical features of the apparatus and corresponding to the foregoing method are omitted for brevity. As the foregoing computer apparatus is corresponding to the display driving method, with respect to the specific technical features of the apparatus and corresponding to the foregoing method are also omitted for brevity.

It should be noted that, the display apparatus is, for example, an LCD, an Organic Light-Emitting Diode (OLED) display, an Quantum Dot Light Emitting Diodes (QLED), a Curved surface display or other displays.

The different technical features of the above embodiments can have various combinations which are not described for the purpose of brevity. Nevertheless, to the extent the combining of the different technical features do not conflict with each other, all such combinations must be regarded as being within the scope of the disclosure.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure.

Therefore, the protection scope of the present disclosure shall be subject to the protection scope of the claims.

What is claimed is:

1. A display driving method, comprising:

acquiring an original gray scale data group of each of pixel units of a content to be displayed in a preset display area;

determining an average gray scale of each of hues in the preset display area according to the original gray scale data group;

acquiring an original light source intensity of each of the hues of the content to be displayed in the preset display area; and dividing the original gray scale data group into a first gray scale data group and a second gray scale data group according to the original gray scale data group of each of the pixel units, the average gray scales of each of the hues, and the original light source intensities, and determining the driving light source intensities of each of the hues in the preset display area; wherein the gray scales of each of the hues of the first gray scale data group are the maximal gray scale in the original gray scale data group; and the gray scales of each of the hues of the second gray scale data group are 0 or greater than the minimal gray scale of the original gray scale data group.

2. The display driving method according to claim 1, wherein the step of determining the average gray scale of each of the hues in the preset display area according to the original gray scale data group comprises:

summing up each of the hues of the original gray scale data group in each of the pixel units respectively, then dividing by the number of pixel units in the preset display area, and obtaining the average gray scales of each of the hues in the preset display area.

3. The display driving method according to claim 1, wherein the step of acquiring the original light source intensity of each of the hues of the content to be displayed in the preset display area comprises: acquiring original light source intensities of each of the hues of the content to be displayed in the preset display area by way of table look-up.

4. The display driving method according to claim 1, wherein the step of determining the driving light source intensities of each of the hues in the preset display area comprises:

acquiring, in the average gray scales and in the second gray scale data group in the preset display area, a first quantity that the gray scale of the hues corresponding to the maximal gray scale is 0, and a second quantity that the gray scale of the hues corresponding to the second maximal gray scale is 0; and when the first quantity satisfies a first preset condition and the second quantity satisfies a second preset condition, determining the driving light source intensities of each of the hues in the preset display area.

5. The display driving method according to claim 1, wherein the step of determining the driving light source intensities of each of the hues in the preset display area comprises:

upon determining that the second gray scale data group is displayed, setting up the driving light source intensity of each of the hues corresponding to the maximal gray scale in the average gray scales of the preset display area to be 0.

6. The display driving method according to claim 4, wherein after the step of dividing the original gray scale data group into the first gray scale data group and the second gray scale data group, the method further comprises:

acquiring an original display duration of the original gray scale data group; and displaying the first gray scale data group and the second gray scale data group continuously in the original display duration.

7. The display driving method according to claim 6, wherein the of displaying the first gray scale data group and the second gray scale data group continuously in the original display duration comprises:

dividing the original display duration into two time periods, and the two time periods are of a same time length; and the first gray scale data group is displayed in one time period, the second gray scale data group is displayed in another time period.

8. The method according to claim 4, wherein the step of dividing the original gray scale data group into the first gray scale data group and the second gray scale data group according to the original gray scale data group of the pixel units, the average gray scales of each of the hues, and the original light source intensities, and determining the driving light source intensities of each of the hues in the preset display area comprises:

determining the driving light source intensities of each of the hues in the preset display area according to the average gray scales of each of the hues; and dividing the original gray scale data group into the first gray scale data group and the second gray scale data group according to the original gray scale data group, the original light source intensities, and the driving light source intensities of the pixel units.

9. The display driving method according to claim 8, wherein the step of dividing the original gray scale data group into the first gray scale data group and the second gray scale data group according to the original gray scale data group, the original light source intensities, and the driving light source intensities of the pixel units comprises:

regarding a maximal gray scale of each of the hues of the pixel units as the gray scale of each of the hues of the first gray scale data group;

determining brightness ratios of the gray scales of each of the hues of the first gray scale data group with respect to a full gray scale according to the gray scales of hues of the first gray scale data group; and determining the brightness ratios of the gray scales of each of the hues of the second gray scale data group with respect to the full gray scale according to the brightness ratios of the gray scales of each of the hues of the first gray scale data group with respect to the full gray scale, the original light source intensities, and the driving light source intensities.

10. The display driving method according to claim 4, wherein prior to the step of acquiring the original gray scale data group of the pixel units of the content to be displayed in the preset display area, the method further comprises:

dividing a display region of the display into at least two display areas and the display areas are sequentially regarded as the preset display area.

11. The display driving method according to claim 4, wherein when the brightness ratio of the hue corresponding to the maximal gray scale in the average gray scale and in the second gray scale data group in the preset display area is no greater than a first preset value, the gray scale of the hues corresponding to the maximal gray scale in the average gray scale and among the second gray scale data group in the preset display area is 0.

12. The display driving method according to claim 4, wherein when the brightness ratio of the hue corresponding to the second maximal gray scale in the average gray scale and in the second gray scale data group in the preset display area is no greater than a second preset value, the gray scale of the hues corresponding to the second maximal gray scale in the average gray scale and among the second gray scale data group in the preset display area is 0.

13. The display driving method according to claim 1, wherein prior to the step of acquiring the original gray scale data group of pixel units of the content to be displayed in the preset display area, the method further comprises:

dividing a display region of a display into at least two display areas, and regarding the display areas as a preset display area sequentially;

and after the step of dividing the original gray scale data group into the first gray scale data group and the a second gray scale data group according to the original gray scale data group of the pixel units, the average gray scales of each of the hues, and the original light source intensities, and determining the driving light source intensities of each of the hues in the preset display area, the method further comprises:

acquiring an original display duration of the original gray scale data group; and displaying the first gray scale data group and the second gray scale data group continuously in the original display duration.

14. A display driving device, comprising:

an original gray scale acquiring module configured to acquire an original gray scale data group of each of pixel units of a content to be displayed in a preset display area;

an average gray scale determination module configured to determine average gray scales of each of hues in the preset display area according to the original gray scale data group;

an original light source acquiring module configured to acquire original light source intensities of each of the hues of the content to be displayed in the preset display area; and a gray scale group dividing module configure to divide the original gray scale data group into a first gray scale data group and a second gray scale data group according to the original gray scale data group of the pixel units, the average gray scales of each of the hues, and the original light source intensities; and determine the driving light source intensities of each of the hues in the preset display area; wherein the gray scales of each of the hues of the first gray scale data group are the maximal gray scale in the original gray scale data group; and the gray scales of each of the hues of the second gray scale data group is 0 or greater than the minimal gray scale of the original gray scale data group.

15. The display driving device in claim 14, wherein the gray scale dividing module is further configured to acquire, in the average gray scales and in the second gray scale data group in the preset display area, a first quantity that the gray scale of the hues corresponding to the maximal gray scale is 0, and a second quantity that the gray scale of the hues corresponding to the second maximal gray scale is 0; and when the first quantity satisfies a first preset condition and the second quantity satisfies a second preset condition, the driving light source intensities of each of the hues in the preset display area are determined.

16. The display driving device of claim 14, wherein the device further comprises:

an original duration acquiring module configured to acquire an original display duration of the original gray scale data group; and a duration dividing module configured to continuously display the first gray scale data group and the second gray scale data group in the original display duration.

17. The display driving device of claim 14, wherein the device further comprises a driving light source determination module:

the driving light source determination module is configured to determine the driving light source intensities of hues in the preset display area according to the average gray scales of each of the hues; and the gray scale group dividing module is configured to divide the original gray scale data group into a first gray scale data group and a second gray scale data group according to the original gray scale data, the original light source intensities, and the driving light source intensities of each of the pixel units.

18. The display driving device of claim 17, wherein the gray scale group dividing module further comprises:

a gray scale determination unit configured to regarding the maximal gray scales of each of the hues of the pixel unit as the gray scales of each of the hues in the first gray scale data group;

a first brightness determination unit configured to determine brightness ratios of the gray scales of each of the hues in the first gray scale data group with respect to a full gray scale according to the gray scales of each of the hues of the first gray scale data group; and a second brightness determination unit configured to determine the brightness ratios of the gray scales of each of the hues in the second gray scale data group with respect to the full gray scale according to the brightness ratios of the gray scales of each of the hues in the first gray scale data group with respect to the full gray scale, original light source intensities, and the driving light source intensities.

19. The display driving device of claim 14, wherein the device further comprises:

a region dividing module configured to divide a display region of a displayer into at least two display areas and sequentially regard the display areas as the preset display area.

20. A computer apparatus comprising a memory, a processor and a computer program stored in the memory and executable on the processor, the processor executes the computer program to provide:

acquiring an original gray scale data group of each of pixel units of a content to be displayed in a preset display area;

determining an average gray scale of each of hues in the preset display area according to the original gray scale data group;

acquiring an original light source intensity of each of the hues of the content to be displayed in the preset display area; and dividing the original gray scale data group into a first gray scale data group and a second gray scale data group according to the original gray scale data group of each of the pixel units, the average gray scales of each of the hues, and the original light source intensities, and determining the driving light source intensities of each of the hues in the preset display area; wherein the gray scales of each of the hues of the first gray scale data group are the maximal gray scale in the original gray scale data group; and the gray scales of each of the hues of the second gray scale data group are 0 or greater than the minimal gray scale of the original gray scale data group.

* * * * *